US011193653B1

(12) United States Patent
Dijkstra et al.

(10) Patent No.: US 11,193,653 B1
(45) Date of Patent: Dec. 7, 2021

(54) IRRADIATION DEVICE WITH A DEFORMABLE OPTIC

(71) Applicant: Light Tree Ventures Holding B.V., The Hague (NL)

(72) Inventors: Alain Dijkstra, Amstelveen (NL); Michael Kasbergen, Schoonhoven (NL)

(73) Assignee: Light Tree Ventures Holding B.V., The Hague (NL)

( * ) Notice: Subject to any disclaimer, the term of this patent is extended or adjusted under 35 U.S.C. 154(b) by 0 days.

(21) Appl. No.: 17/237,077

(22) Filed: Apr. 22, 2021

(51) Int. Cl.

| | |
|---|---|
| ***F21V 14/06*** | (2006.01) |
| ***F21V 15/015*** | (2006.01) |
| ***F21Y 115/15*** | (2016.01) |
| ***F21Y 103/10*** | (2016.01) |
| ***F21Y 115/10*** | (2016.01) |

(52) U.S. Cl.
CPC ..... *F21V 14/06* (2013.01); *F21V 15/015* (2013.01); *F21Y 2103/10* (2016.08); *F21Y 2115/10* (2016.08); *F21Y 2115/15* (2016.08)

(58) Field of Classification Search
CPC .... F21V 14/06; F21V 15/015; F21Y 2103/10; F21Y 2115/10; F21Y 2115/15
USPC ..... 362/277–284
See application file for complete search history.

(56) References Cited

U.S. PATENT DOCUMENTS 8,033,688 B2 10/2011 Warton et al.
8,752,978 B2 6/2014 Bloom et al.

*Primary Examiner* — Jason M Han
(74) *Attorney, Agent, or Firm* — Emanus, LLC; Willie Jacques

(57) ABSTRACT

An irradiation device for generating light beams at variable beam angles, comprises a housing assembly including a longitudinal shell with a first end and a second end, a first end cap assembly provided at the first end, and a second end cap assembly provided at the second end, wherein the first end cap assembly and the second end cap assembly are capable of rotating either individually or in combination, a radiation source configured to emit electromagnetic radiation towards a target region, a deformable optic, the deformable optic including a first side oriented towards the radiation source and a second side oriented towards the target region, and a deformation mechanism adapted to cause a predetermined deformation of the deformable optic. The deformation mechanism includes a first plate and a second plate in contact with the deformable optic.

16 Claims, 8 Drawing Sheets

IRRADIATION DEVICE WITH A DEFORMABLE OPTIC

TECHNICAL FIELD

The present invention generally relates to irradiation devices. More specifically, the present invention relates to irradiation devices that are capable of emitting electromagnetic radiations at variable beam angles.

BACKGROUND ART

Irradiation devices have been known in the art for some time now and are being used in several applications such as medical imaging, therapeutic and recreational applications for pain relief and skincare and spatial lighting applications, etc. However, conventionally available irradiation devices have been known to be designed to emit electromagnetic radiations at a given preconfigured beam angle.

A beam angle, by generally accepted definition in the art, is an angle subtended by two points where the intensity of the emitted radiation is fifty percent of the intensity at a center of a beam spread of a radiation beam. However, with the advancement of technology, devices have been introduced that allow different beam angles to be achieved from within a single device. However, such devices are limited to alternating between a small number of preconfigured discreet beam angles, are generally bulky in construction, and are severely cost-intensive.

Therefore, there is a need in the art for an irradiation device that does not suffer from the aforementioned deficiencies.

OBJECTS OF THE INVENTION

Some of the objects of the present invention are listed below:

It is an object of the present invention to provide an irradiation device that emits electromagnetic radiations at variable beam angles;

It is an additional object of the present invention to provide an irradiation device which is beneficial for both personal and commercial use;

It is an additional object of the present invention to provide an irradiation device which is simple in construction, configuration and operation;

It is an additional object of the present invention to provide an irradiation device that offers an economical way to obtain variable beam angles from within a single irradiation device; and It is a furthermore object of the present invention to provide an irradiation device that is convenient to use.

Other objects, features, advantages, and goals of the present invention will be better understood from the following detailed description taken in conjunction with the accompanying drawings.

SUMMARY

According to an aspect of the present invention, there is provided an irradiation device for generating light beams at variable beam angles, the irradiation device comprising a housing assembly including a longitudinal shell with a first end and a second end, a first end cap assembly provided at the first end and a second end cap assembly provided at the second end, wherein the first end cap assembly and the second end cap assembly are capable of rotating either individually or in combination, a radiation source configured to emit electromagnetic radiation towards a target region, a deformable optic, the deformable optic including a first side oriented towards the radiation source and a second side oriented towards the target region, and a deformation mechanism adapted to cause a predetermined deformation of the deformable optic. The deformation mechanism includes a first plate and a second plate in contact with the deformable optic, wherein, as a result, the predetermined deformation of the deformable optic is adapted to be caused by the relative motion of the first plate and the second plate with respect to each other. The predetermined deformation of the deformable optic is adapted to cause modifications in optical characteristics of the deformable optic, thereby causing modifications in radiation characteristics of the electromagnetic radiation being emitted towards the target region.

In one embodiment of the invention, the rotation of one or both of the first end cap assembly and the second end cap assembly is adapted to cause the actuation of the deformation mechanism, thereby causing the relative motion of the first plate and the second plate with respect to each other.

In another embodiment of the invention, the deformation mechanism is adapted to be actuated using an electrical motor.

In one embodiment of the invention, the electrical motor includes a self-locking shaft.

In one embodiment of the invention, the deformation mechanism includes a drive gear, a first idler gear meshing with the drive gear, and a first driven gear, a second idler gear meshing with the first idler gear, and a second driven gear. The drive gear, the first idler gear, the first driven gear, the second idler gear, and the second driven gear have been mounted on a mounting plate that is adapted to be stationary. Also, the first plate is attached with the first driven gear, and the second plate is attached with the second driven gear.

In one embodiment of the invention, internal surfaces of the one or both of the first and the second end cap assemblies include internal gear teeth, the drive gear is meshing with the internal gear teeth of the one or both of the first and the second end cap assemblies In one embodiment of the invention, the drive gear is adapted to be rotated by an electrical motor.

In one embodiment of the invention, the deformable optic is made from Poly-Di-Methyl-Siloxane (PDMS).

In one embodiment of the invention, the radiation source includes a plurality of Light Emitting Diodes (LEDs).

In one embodiment of the invention, the deformable optic has been impregnated with phosphor material.

In one embodiment of the invention, the deformable optic includes a sachet filled with a fluid, materials of the sachet, and the fluid being diaphanous.

In one embodiment of the invention, the radiation source includes a plurality of Light Emitting Diodes (LEDs).

In one embodiment of the invention, the one or more LEDs are provided on one or more of flexible Organic LED (OLED) and inorganic LED-based panels.

In another embodiment of the invention, the one or more LEDs are provided as a printable composition of micro-LEDs, printed on a substrate.

In one embodiment of the invention, the radiation source is configured to emit electromagnetic radiation in Ultra-Violet (UV), visible light, and Infrared (IR) wavelengths bands of the electromagnetic spectrum.

In one embodiment of the invention, the radiation source is configured to emit electromagnetic radiation in any one of a pulse mode and continuous mode.

In the context of the specification, the term "diaphanous materials" refers to the materials that allow the transmission of electromagnetic radiation, including at least Ultra-Violet (UV), visible light, and Infrared (IR), through them.

In the context of the specification, the term "luminescent materials" refers to the materials that emit radiation (IR to a UV frequency band, inclusive of IR and UV frequencies) under external energy excitation. The energy applied, in the form of high energy electron, photons, or electric field, can then be re-emitted in the form of electromagnetic radiation.

In the context of the specification, the term "refractive index" of a material refers to the ratio of the speed of radiation (such as light) in a medium formed from such material to the speed of radiation in a pure vacuum.

In the context of the specification, terms like "light", "radiation", "irradiation", "emission" and "illumination", etc. have been used synonymously and refer to electromagnetic radiation in a frequency range varying from the Ultraviolet (UV) frequencies to Infrared (IR) frequencies and wavelengths, wherein the frequency range is inclusive of UV and IR frequencies and wavelengths. It is to be further noted here that UV radiation can be categorized in several manners depending on respective wavelength ranges, all of which are envisaged to be under the scope of this invention. For example, UV radiation can be categorized as, Hydrogen Lyman-α (122-121 nm), Far UV (200-122 nm), Middle UV (300-200 nm), Near UV (400-300 nm). The UV radiation may also be categorized as UVA (400-315 nm), UVB (315-280 nm), and UVC (280-100 nm). Similarly, IR radiation may also be categorized into several categories according to respective wavelength ranges which are again envisaged to be within the scope of this invention. A commonly used subdivision scheme for IR radiation includes Near IR (0.75-1.4 μm), Short-Wavelength IR (1.4-3 μm), Mid-Wavelength IR (3-8 μm), Long-Wavelength IR (8-15 μm), and Far IR (15-1000 μm).

The following detailed description is illustrative and is not intended to be in any way limiting. In addition to the illustrative aspects, embodiments, and features described above, further aspects, embodiments, and features will be apparent by reference to the following detailed description in conjunction with the accompanying drawings.

BRIEF DESCRIPTION OF THE ACCOMPANYING DRAWINGS

The accompanying drawings illustrate the best mode for carrying out the invention as presently contemplated and set forth hereinafter. The present invention may be more clearly understood from a consideration of the following detailed description of the preferred embodiments taken in conjunction with the accompanying drawings wherein like reference letters and numerals indicate the corresponding parts in various figures in the accompanying drawings, and in which.

Figure 1A:
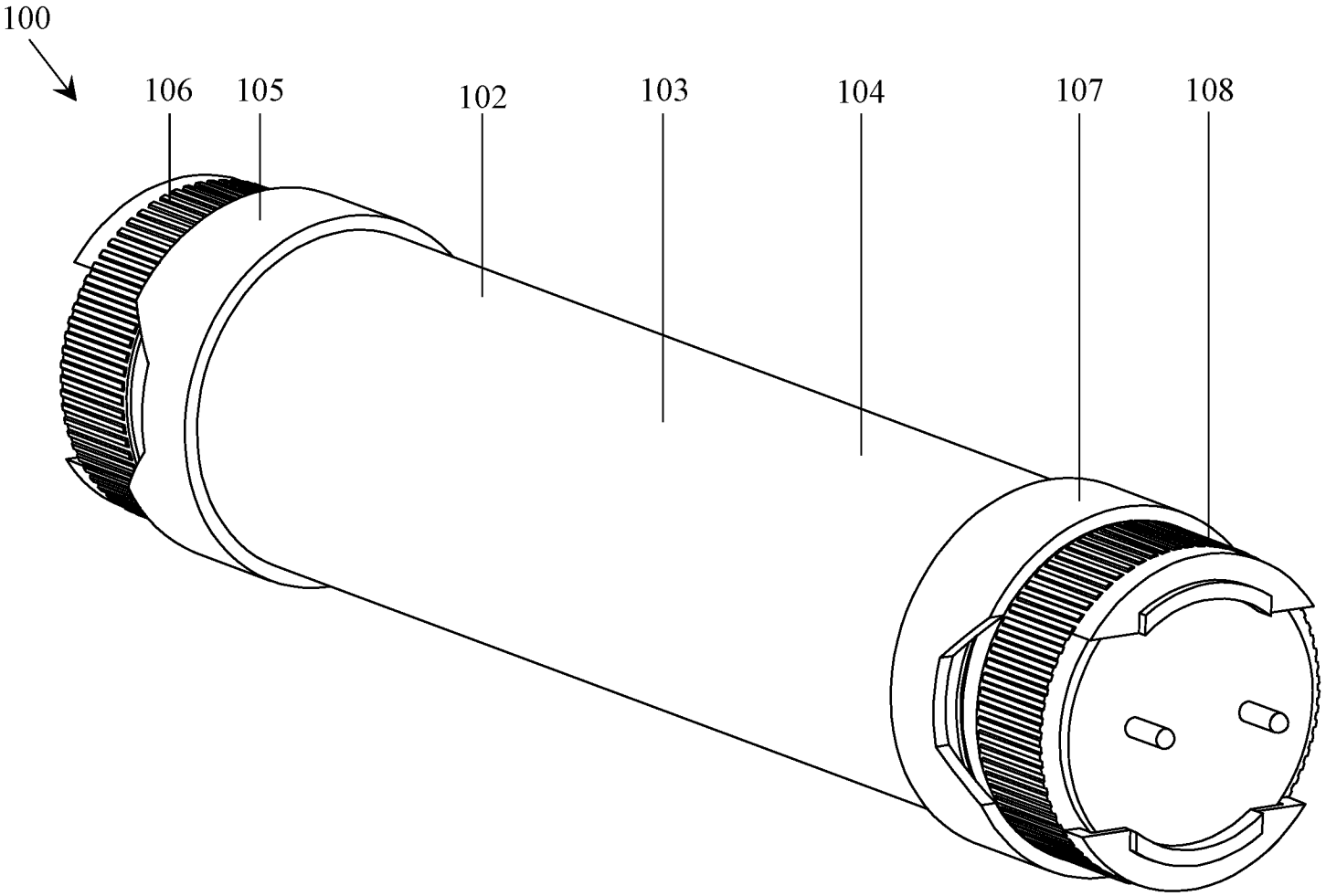
FIG. 1A illustrates a perspective view of an irradiation device, in accordance with an embodiment of the present invention.

While the present invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents, and alternatives falling within the spirit and scope of the present invention as defined by the appended claims and equivalents thereof.

DETAILED DESCRIPTION

Embodiments of the present invention disclosure will be described more fully hereinafter with reference to the accompanying drawings in which like numerals represent like elements throughout the figures, and in which example embodiments are shown.

The detailed description and the accompanying drawings illustrate the specific exemplary embodiments by which the disclosure may be practiced. These embodiments are described in detail to enable those skilled in the art to practice the invention illustrated in the disclosure. It is to be understood that other embodiments may be utilized, and other changes may be made, without departing from the spirit or scope of the present disclosure. The following detailed description is therefore not to be taken in a limiting sense, and the scope of the present invention disclosure is defined by the appended claims. Embodiments of the claims may, however, be embodied in many different forms and should not be construed as limited to the embodiments set forth herein.

The present invention provides an irradiation device that is capable of emitting electromagnetic radiation at variable beam angles. The irradiation device of the present invention has been envisaged to be embodied in a form factor of a linear Light Emitting Diode (LED) tube so that it can easily be mounted on readily available electrical fixtures and hence the invention does not necessitate any significant structural redesign of the fixtures and provide savings on capital investment. In that regard, variations in the beam angle have been achieved through modifying the optical characteristics of a deformable optic by modifying a radius of curvature of the deformable optic. While other optical characteristics of the deformable optic, such as thickness, focal length, concavity, refractive index, color coating, and polarization, etc., may vary depending upon specific applications of the irradiation device.

It is further envisaged, although not bindingly, that sources of the electromagnetic radiation may include Light Emitting Diodes (LEDs) for the invention, because LEDs are relatively more power-efficient than other devices and technologies used for generating electromagnetic radiation, such as fluorescent, halogen, and incandescent lamps. The LEDs in that regard may be mounted on a Printed Circuit Board (PCB) through Surface Mounting Technology (SMT). SMT permits the creation of smaller PCB designs by allowing components to be placed closer together on the board that makes the device more lightweight and compact. The SMT process is faster to set up for production and requires less manufacturing cost than its counterpart, through-hole technology because it does not require the circuit board to be drilled for assembly.

In spatial lighting applications, the irradiation device may be designed to get the desired beam angle of the illumination provided by the irradiation device. The irradiation device in that regard is envisaged to emit visible light at well-known ranges of beam angles including spot (4-19 degrees), flood (20-35 degrees), wide flood (36-49 degrees), and very wide flood (50-120 degrees or more). However, the invention is not limited to the aforementioned beam angle ranges alone. Referring to the figures, the invention will now be described in further detail.

FIG. 1A illustrates a perspective view of an irradiation device 100 with a deformable optic, in accordance with an embodiment of the present invention. The irradiation device 100 as illustrated in FIG. 1A has been embodied in the form of an LED linear tube so that it can easily be installed in fixtures already available for the fluorescent tubes available in the market. This would allow the irradiation device 100 to be adopted with relative convenience without causing any infrastructural expenditures. However, in several alternative embodiments, the irradiation device 100 may be constructed in several alternative shapes and sizes depending upon their specific applications. The irradiation device 100 as shown in FIG. 1A includes a housing assembly 102 which serves to encapsulate other elements and components of the irradiation device 100. The housing assembly 102 includes a longitudinal shell 104 that can be made from a material having good diaphanous properties. For example, the longitudinal shell 104 can be made from glass, plastic, acrylic, or any other diaphanous material which are transparent or translucent to the electromagnetic radiations that would be required for a given application.

The longitudinal shell 104 has a first end 105 and a second end 107. Further, a first end cap assembly 106 has been provided at the first end 105 of the longitudinal shell 104, and a second end cap assembly 108 has been provided at the second end 107 of the longitudinal shell 104. It is envisaged that in several embodiments, external diameters of the first end 105 and the second end 107 be larger than the external diameter of a central longitudinal portion 103 of the longitudinal shell 104, forming two step-like extensions at the ends of the longitudinal shell 104 that may be used to receive in them, the first 106 and the second 108 end cap assemblies, respectively, to ensure that the first 106 and the second 108 end cap assemblies are flush with the central longitudinal portion 103. In several embodiments, the first end cap assembly 106 and the second end cap assembly 108 may be capable of rotating either individually or in combination.

Figure 1B:
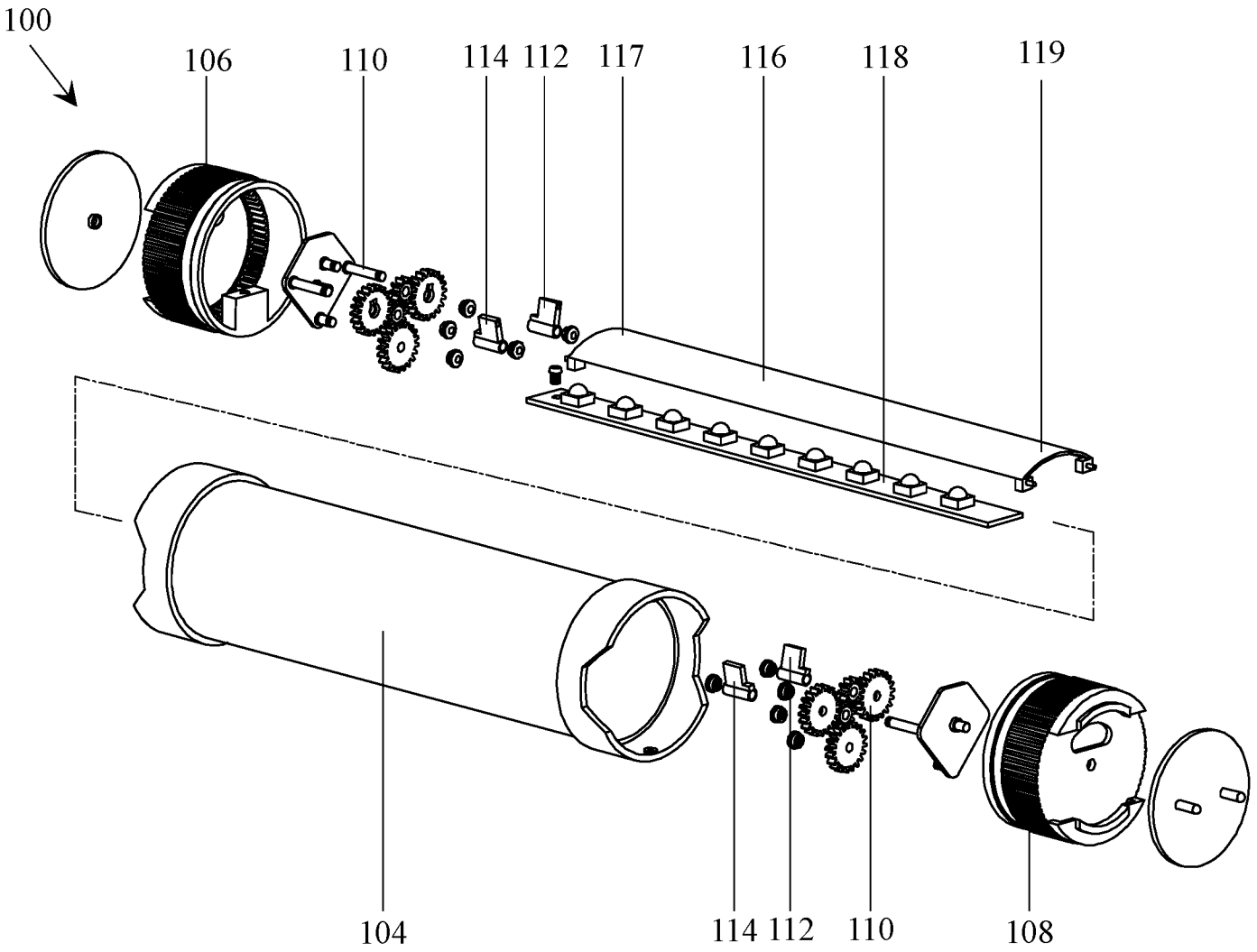
FIG. 1B illustrates an exploded view of the irradiation device of FIG. 1A.

FIG. 1B illustrates an exploded view of the irradiation device 100 of FIG. 1A. A radiation source 118 capable of emitting electromagnetic radiations towards a target region, has been provided within the longitudinal shell 104. The radiation source 118 may be configured to emit electromagnetic radiation in Ultra-Violet (UV), visible light, and Infrared (IR) wavelengths bands of the electromagnetic spectrum, depending upon specific application of the irradiation device 100. Further, the longitudinal shell 104 is made from a material that is at least partially transparent to the electromagnetic radiation emitted by the radiation source 118.

The irradiation device 100 further includes a deformable optic 116. In several embodiments of the invention, the deformable optic 116 is made from Poly-Di-Methyl-Siloxane (PDMS). In place of PDMS, other diaphanous materials may also be used. In several alternate embodiments, the deformable optic 116 includes a sachet filled with fluid. In that regard, materials of the sachet and the fluid being diaphanous. Additionally, the fluid may be provided in the form of a gel. A first end 117 of the deformable optic 116 has been provided within the first end cap assembly 106, and a second end 119 of the deformable optic 116 has been provided within the second end cap assembly 108. Also, the deformable optic 116 has been located between the radiation source 118 and the longitudinal shell 104.

Further, each one of the first end cap assembly 106 and the second end cap assembly 108 includes a respective deformation mechanism 110 adapted to cause a predetermined deformation of the deformable optic 116. The deformation mechanism 110 includes a first plate 112 and a second plate 114 in contact with the deformable optic 116. As a result, the predetermined deformation of the deformable optic 116 is adapted to be caused by the relative motion of the first plate 112 and the second plate 114 with respect to each other. The predetermined deformation of the deformable optic 116 is adapted to cause modifications in optical characteristics of the deformable optic 116, thereby causing modifications in radiation characteristics of the electromagnetic radiation being emitted by the irradiation device 100, towards the target region.

Figure 1C:
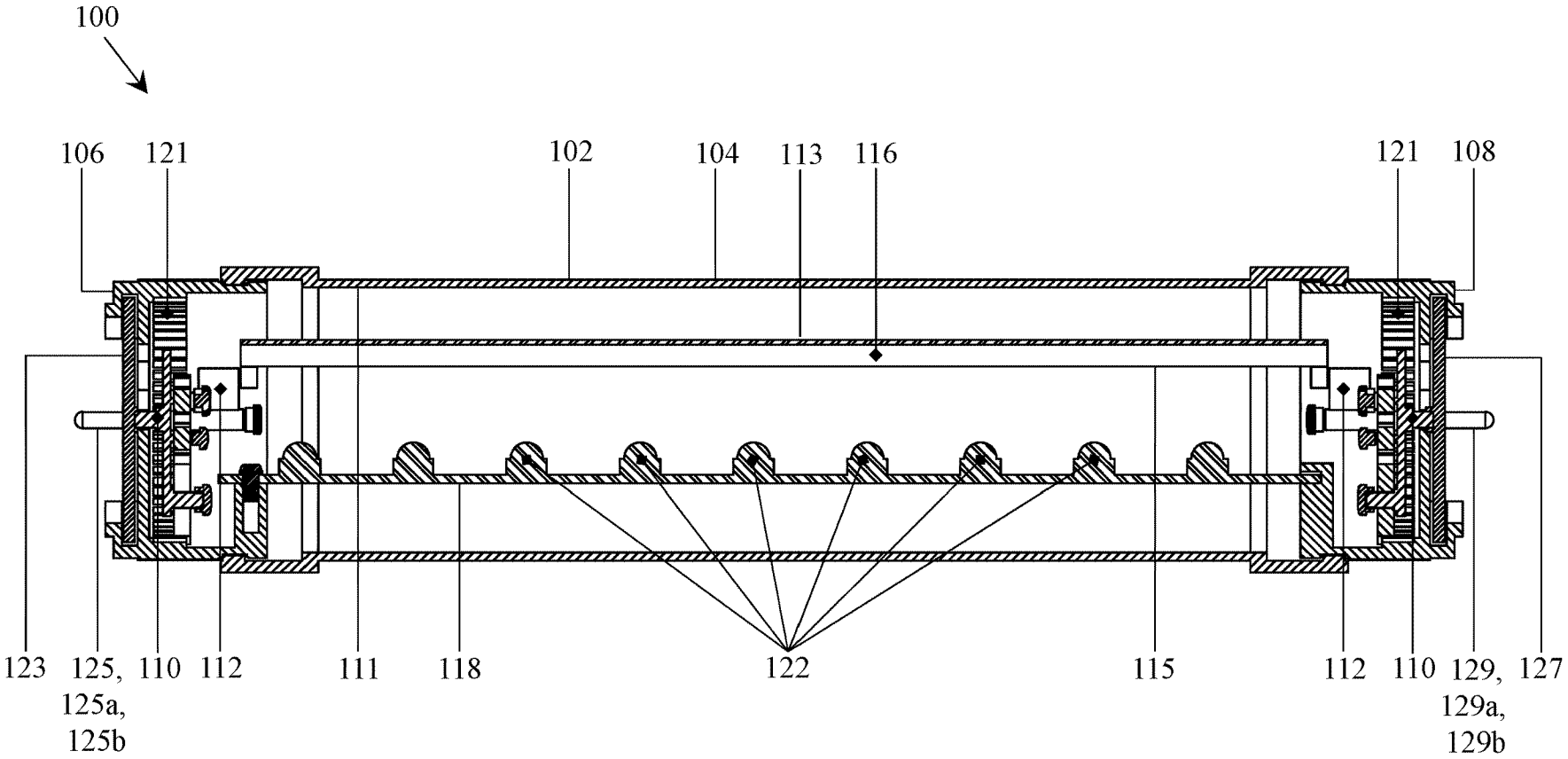
FIG. 1C illustrates a central sectional view of the irradiation device of FIG. 1A.

FIG. 1C illustrates a central sectional view of the irradiation device 100 of FIG. 1A. As illustrated, the deformable optic 116 includes a first side 115 oriented towards the radiation source 118, and a second side 113 oriented towards the target region. Further, the radiation source 118 includes a plurality of Light Emitting Diodes (LEDs) 122. The LEDs are characterized by their superior power efficiencies, smaller sizes, rapidity in switching, physical robustness, and longevity when compared with incandescent or fluorescent lamps. In that regard, the plurality of LEDs 122 may be through-hole type LEDs (generally used to produce electromagnetic radiations of red, green, yellow, blue, and white colors), Surface Mount LEDs, Bi-color LEDs, Pulse Width Modulated RGB (Red-Green-Blue) LEDs, and high power LEDs, etc.

Materials used in the plurality of LEDs 122 may vary from one embodiment to another depending upon the frequency of radiation required. Different frequencies can be obtained from LEDs made from pure or doped semiconductor materials. Commonly used semiconductor materials include nitrides of Silicon, Gallium, Aluminum, and Boron, and Zinc Selenide, etc. in pure form or doped with elements such as Aluminum and Indium, etc. For example, red and amber colors are produced from Aluminum Indium Gallium Phosphide (AlGaInP) based compositions, while blue, green, and cyan use Indium Gallium Nitride based compositions. White light may be produced by mixing red, green, and blue lights in equal proportions, while varying proportions may be used for generating a wider color gamut. White and other colored lightings may also be produced using phosphor coatings such as Yttrium Aluminum Garnet (YAG) in combination with a blue LED to generate white light and Magnesium doped potassium fluorosilicate in combination with blue LED to generate red light. Additionally, near Ultra Violet (UV) LEDs may be combined with Europium based phosphors to generate red and blue lights and Copper and Zinc doped Zinc Sulfide based phosphors to generate green light.

Further, the deformable optic 116 may also be impregnated with a phosphor material, such as those discussed in regards to the plurality of LEDs 122. In several embodiments, the phosphor coatings may also be provided on an inner surface 111 of the longitudinal shell 104 to achieve the illumination in colors required by specific applications. The longitudinal shell 104 can also be made of any one or combinations of nano plastic materials being used in the field of LED linear tubes. For clarity, it is to be noted that the nano plastic materials being used in the field of LED linear tubes generally, or the longitudinal shell 104 in particular, differ from micro and nano plastic particles (also sometimes referred to as secondary nano plastic materials) generated due to degradation of used plastic products. The nano plastic materials (also sometimes referred to as primary nano plastic materials) used in the field of LED linear tubes offer improved mechanical properties like hardness, stiffness, etc. over the over existing available material used in tube light manufacturing. One of the several advantages of using the nano plastic materials is that the nano plastic materials make the irradiation device 100 highly resilient to damage, even when compared to the already robust Poly-Carbonate (PC) and Aluminum materials used in most LED linear tubes in the art.

In addition to conventional mineral-based LEDs, the plurality of LEDs 122 may also be provided on an Organic LED (OLED) based flexible panel or an inorganic LED-based flexible panel. Such OLED panels may be generated by depositing organic semiconducting materials over Thin Film Transistor (TFT) based substrates. Further, discussion on the generation of OLED panels can be found in Bardsley, J. N. (2004), "*International OLED Technology Roadmap", IEEE Journal of Selected Topics in Quantum Electronics*, Vol. 10, No. 1, that is included herein in its entirety, by reference. An exemplary description of flexible inorganic light-emitting diode strips can be found in granted United States Patent Numbered U.S. Pat. No. 7,476,557B2, titled "Roll-to-roll fabricated light sheet and encapsulated semiconductor circuit devices", which is included herein in its entirety, by reference. In several embodiments, the plurality of LEDs 122 may also be micro-LEDs described through U.S. Pat. No. 8,809,126B2, U.S. Pat. No. 8,846,457B2, U.S. Pat. No. 8,852,467B2, U.S. Pat. No. 8,415,879B2, U.S. Pat. No. 8,877,101B2, U.S. Pat. No. 9,018,833B2, and their respective family members, assigned to NthDegree Technologies Worldwide Inc., which are included herein by reference, in their entirety. The plurality of LEDs 122, in that regard, may be provided as a printable composition of the micro-LEDs, printed on a substrate.

Also, illustrated in FIG. 1C are internal gear teeth 121 provided on internal surfaces of the first end cap assembly 106 and the second end cap assembly 108. Due to the presence of the internal gear teeth 121, the rotation of one or both of the first end cap assembly 106 and the second end cap assembly 108, is adapted to cause the actuation of the deformation mechanism 110. The actuation of the deformation mechanism 110 thereby causes the relative motion of the first plate 112 and the second plate 114 with respect to each other, which further causes the predetermined deformation of the deformable optic 116. It is further a design objective that the first 106 and the second 108 end cap assemblies be rotatable even when the irradiation device 100 has been installed in a fixture. In order to ensure unobstructed rotation of the first 106 and the second 108 end cap assemblies, first electrical terminals 125 (125*a*, 125*b*) have been provided on a first discrete disc 123 and second electrical terminals 129 (129*a*, 129*b*) has been provided on a second discrete disc 127. The first 123 and the second 127 discrete discs, even though coaxial with the first 106 and the second 108 end cap assemblies, respectively, remain mounted to the fixtures without rotating. This type of constructions is typically suited for bi-pin types of socket designs (shunted or non-shunted). However, a person skilled in the art would appreciate that the same concept can be extended to other kinds of socket designs, such as single pin, quad pin, or recessed double contacts, etc.

Figure 1D:
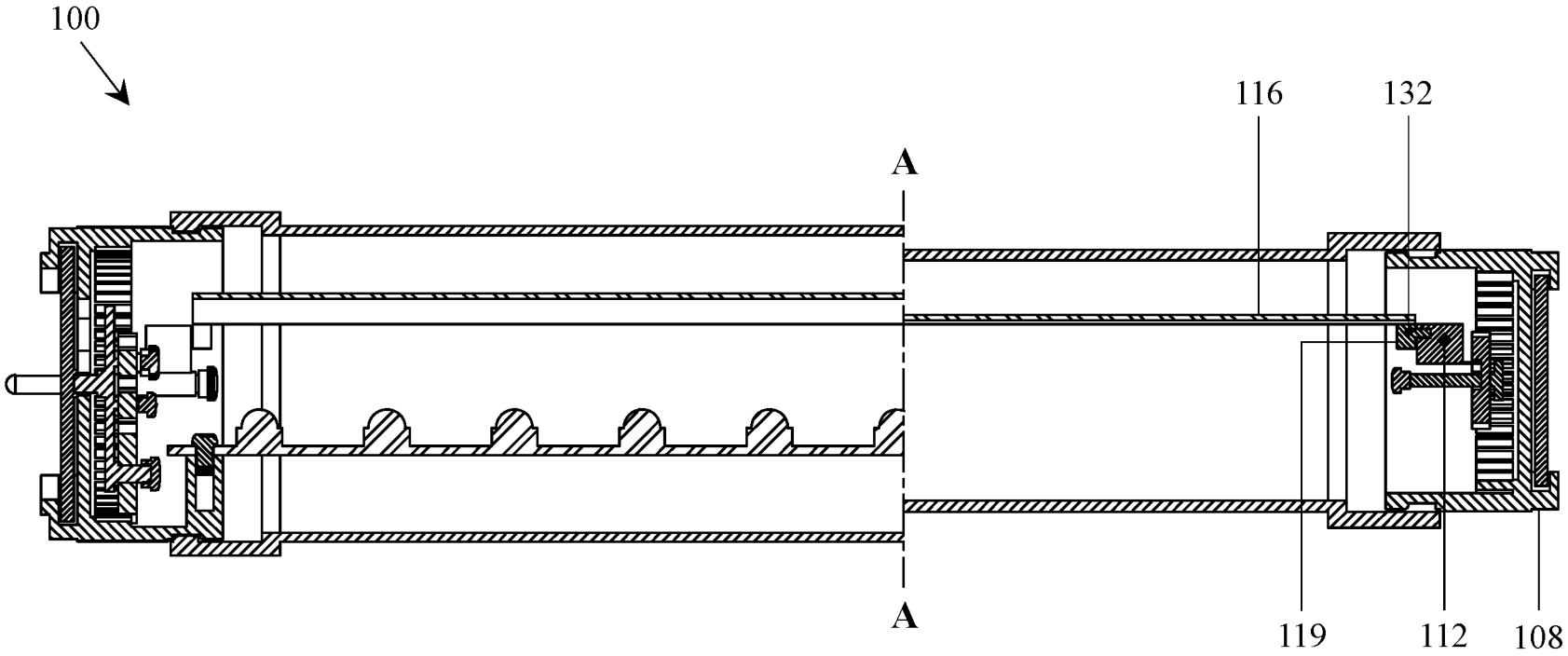
FIG. 1D illustrates a partial sectional view of the irradiation device of FIG. 1A.

FIG. 1D illustrates a partial sectional view of the irradiation device 100 of FIG. 1A. The partial sectional view illustrates the mounting of the deformable optic 116 with the first plate 112. The second end 119 of the deformable optic 116 includes an insertion member 132 with a protrusion that may be inserted into a blind or through-hole provided in the first plate 112, to attach the deformable optic 116 with the first plate 112, by achieving an interference fit or a clearance fit. The insertion member 132 may be provided at one of two lateral edges of the second end 119 of the deformable optic 116. The partial sectional view of FIG. 1D only illustrates the attachment of the deformable optic 116 with the first plate 112 within the second end cap assembly 108. However, a person skilled in the art would appreciate that the same attachment design may be extended to the mounting of the deformable optic 116 with the second plate 114, by using another insertion member at another lateral edge of the second end 119, within the second end cap assembly 108, and also with the first 112 and the second 114 plates provided within the first end cap assembly 106.

Figure 2A:
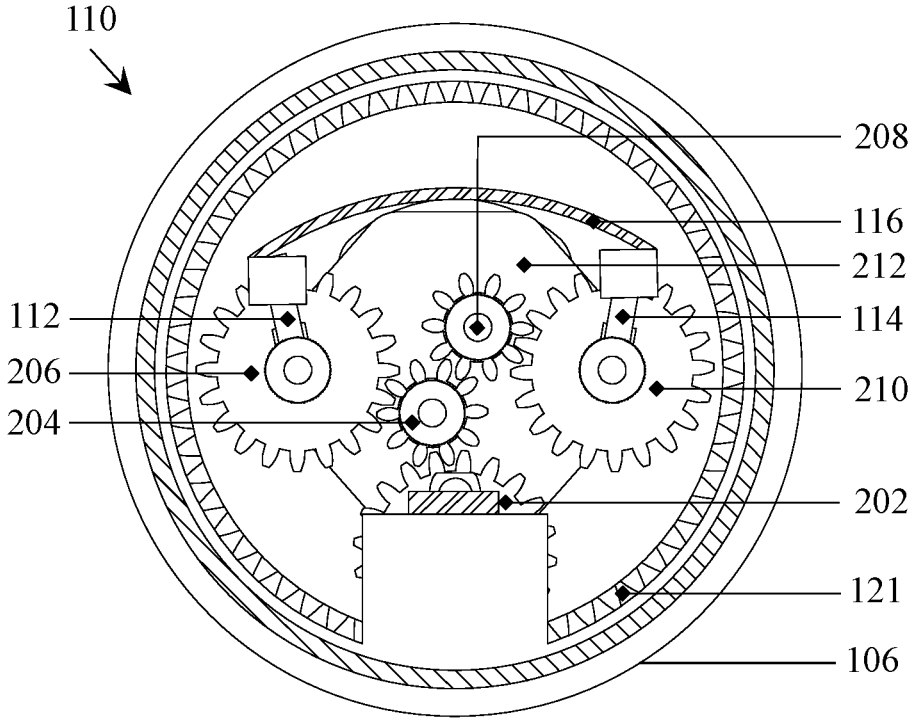
FIG. 2A illustrates a deformation mechanism of the irradiation device of FIG. 1A, in a first position, in accordance with an embodiment of the present invention.
Figure 2B:
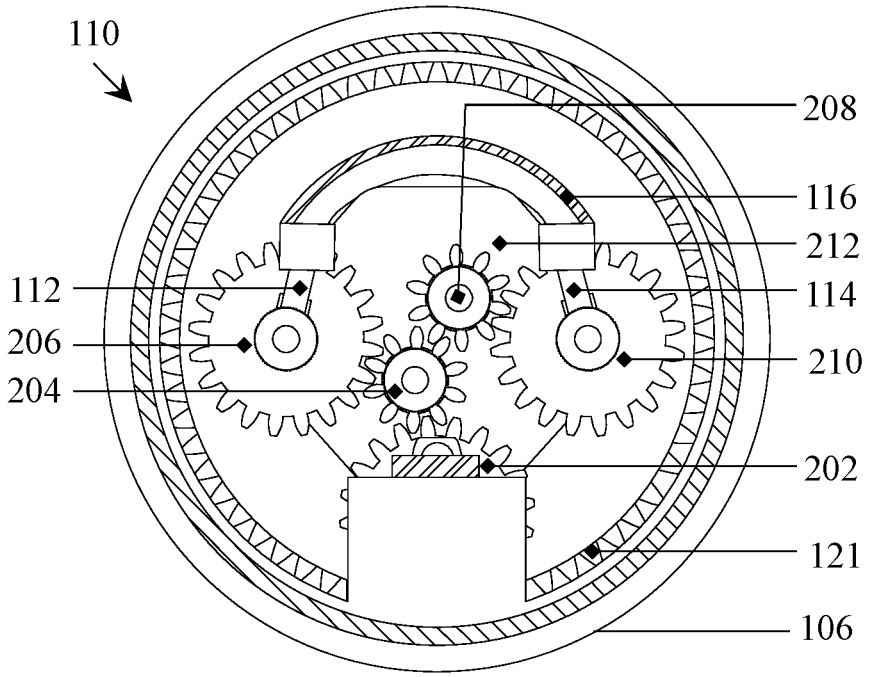
FIG. 2B illustrates the deformation mechanism of the irradiation device of FIG. 2A, in a second position.

FIG. 2A illustrates the deformation mechanism 110 of the irradiation device 100 of FIG. 1A, in a first position, in accordance with an embodiment of the present invention. FIG. 2B illustrates the deformation mechanism 110 of the irradiation device 100 of FIG. 2A, in a second position FIG. 2A illustrates a drive gear 202, a first idler gear 204 that is meshing with the drive gear 202, and a first driven gear 206. Further, a second idler gear 208 is meshing with the first idler gear 204 and a second driven gear 210. The drive gear 202, the first idler gear 204, the first driven gear 206, the second idler gear 208, and the second driven gear 210 have been mounted on a mounting plate 212 that is adapted to be stationary. Further, the first plate 112 is attached with the first driven gear 206, and the second plate 114 is attached with the second driven gear 210. Also, the drive gear 202 is meshing with the internal teeth 121 of the first end cap assembly 106. The same construction of the deformation mechanism 110 may also be provided in the second end cap assembly 108.

Therefore, the rotation of one or both of the first end cap assembly 106 and the second end cap assembly 108 is adapted to cause the actuation of the deformation mechanism 110. As illustrated in FIGS. 2A and 2B, once the first end cap assembly 106 is rotated in the counter-clockwise direction, the internal teeth 121 would cause the rotation of the drive gear 202 in the clockwise direction. The clockwise rotation of the drive gear 202 would cause the counter-clockwise rotation of the first idler gear 204, which in turn would cause the clockwise rotation of the first driven gear 206 and the second idler gear 208. The clockwise rotation of the second idler gear 208 would cause the counter-clockwise rotation of the second driven gear 210. Hence, the clockwise rotation of the first driven gear 206 and the counter-clockwise rotation of the second driven gear 210 would cause the first plate 112 and the second plate 114 to displace closer with respect to each other, thereby decreasing the radius of curvature of the deformable optic 116.

Depending upon which end cap assembly is being rotated, the rotation in one direction, for example in the clockwise direction, would cause the first plate 112 and the second plate 114 to move apart, thereby increasing a radius of curvature of the deformable optic 116. While, the rotation in an opposite direction, such as the counter-clockwise direction, would cause the first plate 112 and the second plate 114 to move closer, thereby decreasing the radius of curvature of the deformable optic 116. In FIG. 2A, the deformable optic 116 has been illustrated in an expanded form, while in FIG. 2B, the deformable optic 116 has been illustrated in a contracted form. A person skilled in the art would appreciate that the description of the deformation mechanism 110, as provided in the aforementioned discussion, is not to limit the deformation mechanism 110 to the given construction, instead, the deformation mechanism 110 may be designed in several alternative forms, without departing from the scope of the invention.

In principle, the relation between the beam angle and the radii of curvature of a lens varies according to the type of lens used. For example, a simple lens can have several different geometries such as Biconvex, Plano-convex, Positive meniscus, Negative meniscus, Plano-concave, and Biconcave. For, this specification, the deformable optic 116 has been given a Negative meniscus geometry. In that regard, the beam angle of the irradiation should increase as the mean radius of curvature of the deformable optic 116 is reduced.

Figure 3A:
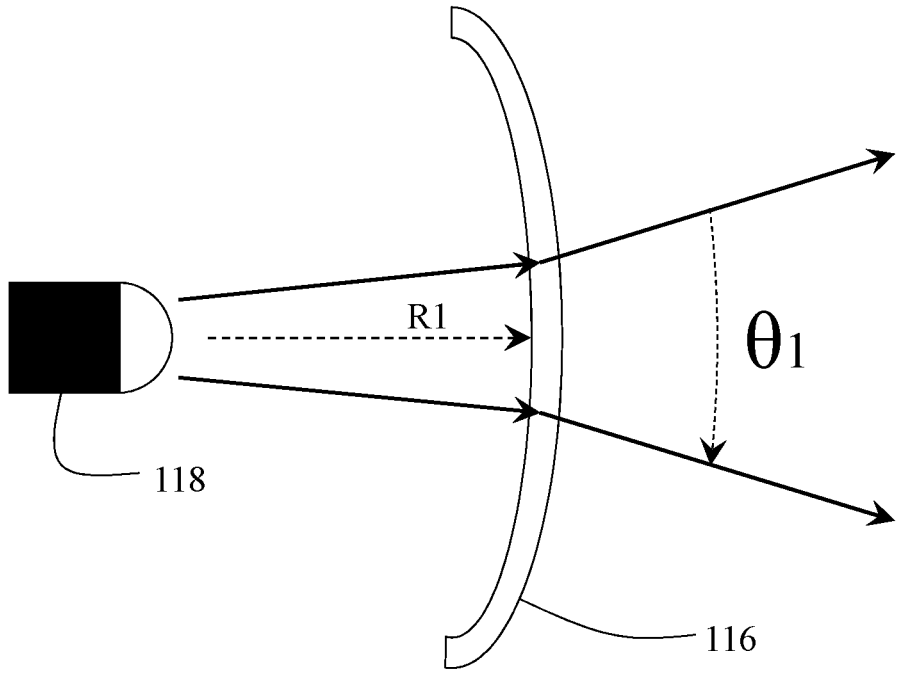
FIG. 3A illustrates a beam angle of the irradiation emitted by the irradiation device of FIG. 1A, in a first deformed state of a deformable optic.

FIG. 3A illustrates a beam angle of the irradiation emitted by the irradiation device 100 of FIG. 1A, in a first deformed state of the deformable optic 116. The deformable optic 116 has a mean radius of curvature R1, and is aligned with the radiation source 118. As shown, $\theta_1$ is the beam angle produced by the irradiation device 100.

Figure 3B:
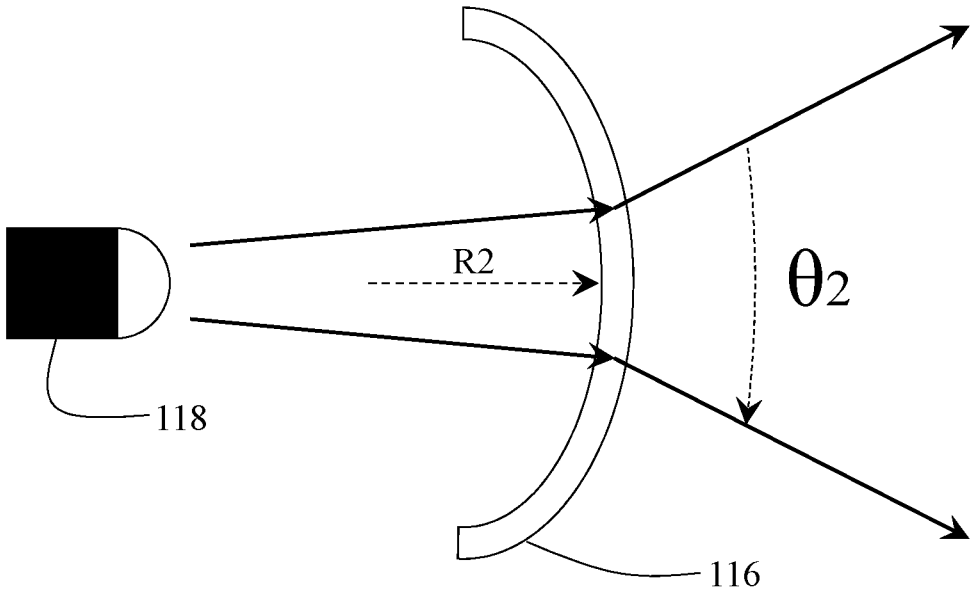
FIG. 3B illustrates a beam angle of the irradiation emitted by the irradiation device of FIG. 1A, in a second deformed state of the deformable optic.

FIG. 3B illustrates a beam angle of the irradiation emitted by the irradiation device 100 of FIG. 1A, in a second deformed state of the deformable optic 116. The deformable optic 116 has a mean radius of curvature R2, and is aligned with the radiation source 118. As shown, $\theta_2$ is the beam angle produced by the irradiation device 100. In this case, radius R1 is greater than the R2, and therefore the beam angle ($\theta_2$) is greater than the ($\theta_1$).

Figure 4A:
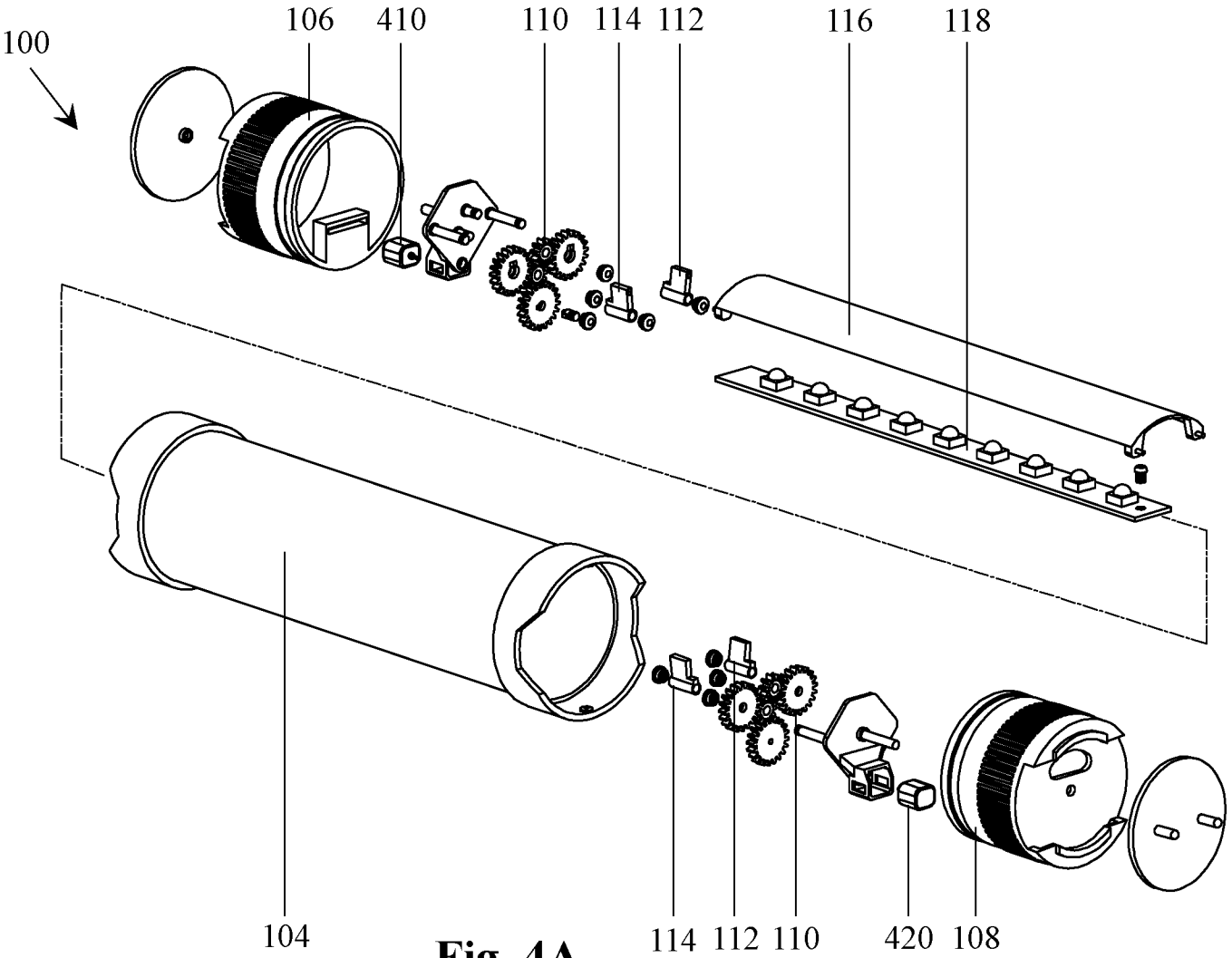
FIG. 4A illustrates an exploded view of the irradiation device, in accordance with another embodiment of the present invention.

FIG. 4A illustrates an exploded view of the irradiation device 100, in accordance with another embodiment of the present invention. Actuators in the forms of a first electrical motor 410 and a second electrical motor 420 have been provided within the first end cap assembly 106 and the second end cap assembly 108, respectively. In that regard, the first 410 and the second 420 electrical motors may be synchronized motors that are capable of operating simultaneously to provide optimal torque and response times for the actuation of the deformation mechanism 110 by enabling rotation of the drive gear 202, and hence the deformation of the deformable optic 116. However, in several alternate embodiments, the first 410 and the second 420 electrical motors may serve different purposes. For example, the first electrical motor 410 may have the least measurable degree of rotation at least ten times that of the second electrical motor 420. In that regard, the first electrical motor 410 may be configured for coarse adjustment and the second electrical motor 420 may be configured for fine adjustment of the deformable optic 116. Also, it is envisaged that, in several embodiments, the first 410 and the second 420 electrical motors may have self-locking shafts, such as worm and worm gear type or solenoid brake type arrangements, that prevent maladjustment of the deformable optic 116 during utilization of the irradiation device 100. Also, in construction, the first 410 and the second 420 electrical motors may be AC motors, DC motors, servo motors, stepper motors, or the like.

Figure 4B:
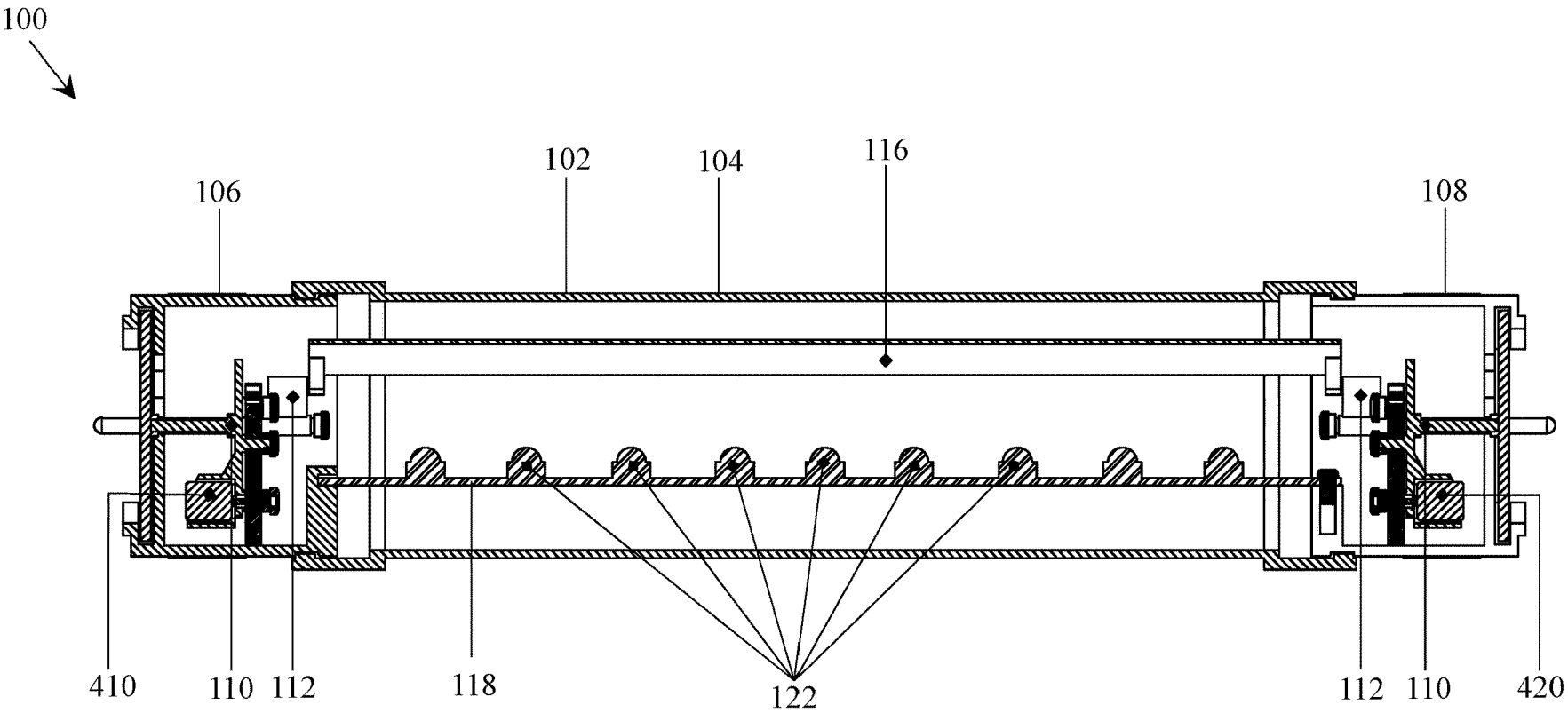
FIG. 4B illustrates a central sectional view of the irradiation device of FIG. 4A.

FIG. 4B illustrates a central sectional view of the irradiation device 100 of FIG. 4A. As illustrated in FIG. 4B, the deformation mechanism 110 is coupled to the first electrical motor 410 in the first end cap assembly 106, and another deformation mechanism 110 coupled with the second electrical motor 420 has been provided in the second end cap assembly 108. The deformable optic 116 may be of any one or more types including concave, convex, or Fresnel lenses. However, the invention is not limited to the aforementioned concave, convex, and Fresnel lenses, instead, different types of lenses having distinct focal lengths can be used for the invention.

In use, a user may either manually rotate the one or more of the first 106 and the second 108 end cap assemblies or actuate the one or more of the first electrical motor 410 and the second electrical motor 420, of the irradiation device 100, either remotely or through a contact-based switch. Due to the rotational motion of the drive gear 202 of the deformation mechanism 110, there will be a modification in the mean radius of curvature of the deformable optic 116, resulting in modification of the beam angle of the irradiation being emitted by the irradiation device 100.

The irradiation device 100 has been designed to operate both as a therapeutic device for non-invasive radiation treatment for conditions such as skin acne and aging, muscle spasms and inflammations, and in some cases benign or malignant lesions, and as an artificial lighting device in spatial lighting applications. In that regard, during utilization of the irradiation device 100 for therapeutic applications, the key factors that may affect the efficacy of the treatment include wavelengths, the power density of irradiation, time of exposure, distance of the affected area from the irradiation device 100, and mode of operation of the radiation source 118. In that regard, the radiation source 118 may be configured to operate in pulsed or continuous mode. As a further discussion, for input current of (I mA) and an applied voltage of (V Volts), the Input Power ($P_1$) being supplied to the irradiation device 100 would be given by equation (1).

$$P_I = V \times I \text{ mW} \tag{1}$$

For the overall efficiency ($\eta$) of the irradiation device 100, the Output Power ($P_O$) would be given by equation (2).

$$P_O = \eta \times P_I \text{mW} \tag{2}$$

The area (A) being effectively irradiated by the irradiation device 100, with a beam angle ($\theta$), for a subject standing at a distance (d cm) would be given by equation (3).

$$A = \pi \times \left(d \times \tan\left(\frac{\theta}{2}\right)\right)^2 \text{cm}^2 \tag{3}$$

Hence, the Power Density ($P_d$) being received at the distance (d) would be given by the equation (4).

$$P_d = K \times \frac{P_o}{A} \text{ mW/cm}^2 \tag{4}$$

Where K is the correction factor for accounting for the entire beam spread that will be greater than the beam angle. The correction factor 'K' may be empirically determined during the calibration of the irradiation device 100. Therefore, the dosage (D) and total irradiant energy ($E_a$) being absorbed by the subject, receiving treatment for a time period (T seconds) would be given by equations (5) and (6), respectively.

$$D=P_a t\times \text{mJ/cm}^2 \quad (5)$$

$$E_a=D\times A \text{ mJ} \quad (6)$$

From equations (1) to (6) it can thus be inferred that for a given design of the irradiation device 100, the treatment received by the subject individual may be varied by varying parameters such as the input current, applied voltage, beam angle of the irradiation, distance of the subject from the irradiation device and treatment time, etc. For example, an effective dose for wound healing is 90 J/cm$^2$. It has to be further noted that the value of input current, applied voltage, and construction of the radiation source 118 (for example be it lasers or LEDs) will also be dictated by other factors such as type of condition (for example, acne, deep wounds, and lesions, etc.) and type of radiation output (for example, blue light, UV radiation, red light or IR radiation) suited for that condition.

Alternately, during utilization of the irradiation device 100 as an artificial lighting device for spatial lighting, a different set of characteristics come into play. Moreover, it is to be noted that in such applications the irradiation device 100 would most likely be emitting radiation in form of the wide spectrum visible light and therefore the efficacy of the irradiation device 100 would be evaluated differently than as described through equations (1) to (6). The key characteristics in the application of the irradiation device 100 for spatial lighting applications include angular span, beam angle, apex angle, and a distance of a surface being illuminated from the irradiation device 100, luminous intensity and luminous flux being emitted. For a surface at a distance (d) cm from the irradiation device 100, emitting visible light at a beam angle (θ), the apex angle (α) would be determined from equation (7) and angular span (α) would be determined from equation (8).

$$\alpha=2\theta \quad (7)$$

$$\sigma = 2\pi\left(1-\cos\left(\frac{\alpha}{2}\right)\right) \text{ steradians} \quad (8)$$

For a given luminous intensity (C candela), the luminous flux (L) would be determined from equation (9).

$$L=C\times\sigma \text{lumens} \quad (9)$$

Thus, the illumination of the surface, also known as the lux value at the surface may be determined by dividing the luminous flux (L) with the area (A) determined from equation (3). The lux value (l) is thus given by equation (10).

$$l = \frac{L}{A} \text{ lumens/cm}^2 \quad (10)$$

The lux value (l) is generally the value that is measured by light meters. Also, it can be seen from equation (10) and (3) that the lux value, therefore, depends on the beam angle and the distance of the surface from the irradiation device 100.

Example 1

As an example, for an irradiation device 100 rated at luminous intensity (C) of 1500 candela at an apex angle (α) of 100 degrees, the beam angle (θ), angular span (α), and luminous flux (L) would be determined as below:

$$\theta = \frac{100}{2} = 50°$$

$$\sigma = 2\pi\left(1-\cos\left(\frac{100}{2}\right)\right) = 2.244 \text{ steradians}$$

$$L = 2.244\times 1500 = 3367 \text{ lumens}$$

For a surface that is at a distance of 1 m or 100 cm from the irradiation device 100, the illumination of the surface or lux value (1) would be determined as follows:

$$A = \pi\times\left(100\times\tan\frac{35}{2}\right)^2 = 3123.2 \text{ cm}^2$$

$$l = \frac{3367}{3123.2} = 1.078 \text{ lumens/cm}^2$$

The embodiments of the invention as described above offer several advantages including simplicity in design and construction, novel and inventive use of readily available materials. Further, the incorporation of LEDs as the radiation source provides significant power economies. Also, the use of gears for beam angle adjustment allows simple construction and cheaper overall cost of the irradiation device. The same construction of the irradiation device can be used for multiple applications with minor constructional modifications. Moreover, the operation of the irradiation device does not demand special skills on the part of the user or the operator and is therefore suited for both domestic applications (where convenience is the key) and commercial applications (where the economy is the key).

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

The invention claimed is:

1. An irradiation device for generating light beams at variable beam angles, the irradiation device comprising:

a housing assembly including:

a longitudinal shell with a first end and a second end, a first end cap assembly provided at the first end and a second end cap assembly provided at the second end, wherein the first end cap assembly and the second end cap assembly are capable of rotating either individually or in combination, a radiation source configured to emit electromagnetic radiation towards a target region, a deformable optic, the deformable optic including a first side oriented towards the radiation source and a second side oriented towards the target region, and a deformation mechanism adapted to cause a predetermined deformation of the deformable optic, wherein the deformation mechanism includes a first plate and a second plate in contact with the deformable optic, wherein, as a result, the predetermined deformation of the deformable optic is adapted to be caused by relative motion of the first plate and the second plate with respect to each other;

wherein the predetermined deformation of the deformable optic is adapted to cause modifications in optical characteristics of the deformable optic, thereby causing modifications in radiation characteristics of the electromagnetic radiation being emitted towards the target region.

2. The irradiation device as claimed in claim 1, wherein rotation of one or both of the first end cap assembly and the second end cap assembly is adapted to cause actuation of the deformation mechanism, thereby causing the relative motion of the first plate and the second plate with respect to each other.

3. The irradiation device as claimed in claim 1, wherein the deformation mechanism is adapted to be actuated using an electrical motor.

4. The irradiation device as claimed in claim 1, wherein the deformation mechanism includes:

a drive gear;

a first idler gear meshing with the drive gear and a first driven gear;

a second idler gear meshing with the first idler gear and a second driven gear;

wherein the drive gear, the first idler gear, the first driven gear, the second idler gear, and the second driven gear have been mounted on a mounting plate that is adapted to be stationary; and wherein the first plate is attached with the first driven gear, and the second plate is attached with the second driven gear.

5. The irradiation device as claimed in claim 4, wherein internal surfaces of the one or both of the first and the second end cap assemblies include internal gear teeth, the drive gear is meshing with the internal gear teeth of the one or both of the first and the second end cap assemblies.

6. The irradiation device as claimed in claim 4, wherein the drive gear is adapted to be rotated by an electrical motor.

7. The irradiation device as claimed in claim 6, wherein the electrical motor includes a self-locking shaft.

8. The irradiation device as claimed in claim 1, wherein the deformable optic is made from Poly-Di-Methyl-Siloxane (PDMS).

9. The irradiation device as claimed in claim 1, wherein the radiation source includes a plurality of Light Emitting Diodes (LEDs).

10. The irradiation device as claimed in claim 1, wherein the deformable optic has been impregnated with phosphor material.

11. The irradiation device as claimed in claim 1, wherein the deformable optic includes a sachet filled with a fluid, materials of the sachet and the fluid being diaphanous.

12. The irradiation device as claimed in claim 1, wherein the radiation source includes a plurality of Light Emitting Diodes (LEDs).

13. The irradiation device as claimed in claim 12, wherein the one or more LEDs are provided on one or more of flexible Organic LED (OLED) and inorganic LED-based panels.

14. The irradiation device as claimed in claim 12, wherein the one or more LEDs are provided as a printable composition of micro-LEDs, printed on a substrate.

15. The irradiation device as claimed in claim 1, wherein the radiation source is configured to emit the electromagnetic radiation in Ultra-Violet (UV), visible light, and Infrared (IR) wavelengths bands of the electromagnetic spectrum.

16. The irradiation device as claimed in claim 1, wherein the radiation source is configured to emit the electromagnetic radiation in any one of a pulse mode and continuous mode.

* * * * *